US006553715B1

(12) United States Patent
Lönnberg

(10) Patent No.: US 6,553,715 B1
(45) Date of Patent: Apr. 29, 2003

(54) DEVICE FOR TURNABLE AND SLIDABLE SUSPENSION OF PLATES

(76) Inventor: Benth Lönnberg, Drottninggatan 118, 252 22, Helsingborg (SE)

( * ) Notice: Subject to any disclaimer, the term of this patent is extended or adjusted under 35 U.S.C. 154(b) by 0 days.

(21) Appl. No.: 10/009,441

(22) PCT Filed: Jun. 9, 2000

(86) PCT No.: PCT/SE00/01204

§ 371 (c)(1),
(2), (4) Date: Jan. 2, 2002

(87) PCT Pub. No.: WO00/77328

PCT Pub. Date: Dec. 21, 2000

(30) Foreign Application Priority Data

Jun. 10, 1999 (SE) ..... 9902195

(51) Int. Cl.[7] ..... E05D 15/26
(52) U.S. Cl. ..... 49/127; 49/125; 160/196.1
(58) Field of Search ..... 49/125, 127, 128, 49/409; 160/199, 196.1, 206

(56) References Cited

U.S. PATENT DOCUMENTS 3,810,330 A * 5/1974 Daggy ..... 49/127
6,065,247 A * 5/2000 Sundvall ..... 49/258
6,301,833 B1 * 10/2001 Airkkala ..... 49/409
6,397,522 B1 * 6/2002 Nussbaum ..... 49/127

* cited by examiner

*Primary Examiner*—Jerry Redman
(74) *Attorney, Agent, or Firm*—Breiner & Breiner, L.L.C.

(57) ABSTRACT

A device for turnable and slidable suspension of sheet elements including a coupling member (100) which is supported by a rail and has an elongate groove (101) in essentially the same direction as the rail, and a coupling pin which is non-rotationally arranged on the sheet element coinciding with its pivot axis and which is slidable in the groove of the coupling member. The groove of the coupling member has an inclined lateral cam surface (102) and at least one essentially part-circular recess (104), with a center axis (E) which is essentially parallel to the pivot axis of the sheet element, in the inclined lateral surface (102). The coupling pin has a cylindrical surface with a center axis which is essentially parallel to the pivot axis of the sheet element, the cylindrical surface having a beveled portion of a shape which is essentially the same as the cam shape of the lateral surface in the groove of the coupling member, the coupling pin and the coupling member being adapted to engage each other when the sheet element is turned relative to the rails.

17 Claims, 4 Drawing Sheets

DEVICE FOR TURNABLE AND SLIDABLE SUSPENSION OF PLATES

FIELD OF THE INVENTION

The present invention relates to a device for turnable and slidable suspension of sheet-like elements, which are slidably supported by at least one rail and which are turnable about a pivot axis which is fixed relative to the sheet-like element. The device comprises a coupling member which is supported by said rail and has an elongate groove in essentially the same direction as the rail, and a coupling pin which is non-rotationally arranged on the sheet-like element so as to coincide with the pivot axis and which is slidable in the groove of the coupling member, the coupling pin and the coupling member being adapted to engage each other when the sheet-like element is turned relative to the rail.

BACKGROUND ART

A device of the type stated by way of introduction is known from Patent Specification WO 94/09238, in which a sliding element system, with guide wheels at the upper rail and a supporting wheel at the lower rail, for suspension of windowpanes is described. For the lower wheel to follow the correct path, a groove is formed in the lower rail. The forming of the lower wheel so as to have a rounded running tread engaging the edges of the groove and so as to be non-rotating relative to the windowpane results in the property that, when opening the window, the wheel is turned relative to the groove, which causes the wheel to rise. This motion is used to let a pin adjacent to the upper wheel enter a hole in the upper rail. When the pin is positioned in the hole and the lower wheel is arranged transversely in the rail, these two elements are locked relative to the longitudinal direction of the rails, which means that the windowpane cannot tilt when in the open position.

Without such locking, the windowpane would tilt by the upper part of the windowpane, owing to the weight of the windowpane which causes a moment relative to the suspension from the rails in the plane of the windowpane, sliding along the upper rail and the lower part of the windowpane sliding along the lower rail. This construction necessitates a large number of components, which makes the solution expensive. Moreover, when using this construction, there is a great risk that, when opening the windowpane by turning, the windowpane is turned upwards to a position in which the pin does not coincide with a hole, which results in a risk that the entire supporting structure is damaged or the windowpane is broken.

A further prior art device of the type stated by way of introduction is disclosed in WO 92/17673 and WO 93/08355. These two specifications disclose a device with a coupling member which is attached to an upper rail and chisel-like pin of rectangular cross-section, which is attached to the windowpane which is slidingly and turnably suspended between the upper rail and a lower rail. The coupling member has an elongate groove which is slightly broader than the smallest dimension of the chisel and extends through the coupling member in the longitudinal direction of the rail. A number of circular recesses are formed along the groove. Each of these circular recesses accommodates a turnable sleeve, which is formed with a groove which in a certain direction of rotation of the sleeve coincides with the groove of the coupling member. When the chisel is made to slide in the groove of the coupling member, with one of its short sides in the sliding direction, it also passes through the groove in each of the sleeves. The largest dimension of the chisel is slightly smaller than the diameter of the turning sleeve and the recess. Thus, when the chisel merely rests against the rail inside a turning sleeve, it is possible to open the windowpane by turning the same round the chisel and the axis that forms.

The number of components in this device is large, and narrow tolerances are necessary in respect of the mounting of the rails for the device to work in a satisfactory manner.

Also in connection with this construction, there is a great risk that the rail or the coupling device is damaged if the chisel is not arranged so as to coincide exactly with the turning sleeve. Great forces arise since the user utilises a great lever when grasping the windowpane and the coupling device has just extremely small levers since the profile of the rail must accommodate all the components.

A problem which is common to these two constructions thus is that there is a risk of breaking the rail or the coupling device by turning if the windowpane is not arranged in the correct position. Furthermore they necessitate narrow mounting tolerances and they are composed of a large number of components. As a result, it will be expensive to manufacture and mount the windowpanes and there is no space for absorbing settlements in the building structure or wear on the components included in the construction.

SUMMARY OF THE INVENTION

The object of the invention is to solve the problems described above and thus provide a device for slidable and turnable suspension of sheet-like elements, which is simple and robust.

This object is achieved by a device which is of the type described by way of introduction and characterized in that the groove of the coupling member has an inclined, lateral cam surface, that the coupling member has at least one essentially part-circular recess in the inclined lateral surface, the recess having a center axis which is essentially parallel to the pivot axis of the sheet-like element, that the coupling pin has a cylindrical surface with a center axis which is essentially parallel to the pivot axis of the sheet-like element, and that the cylindrical surface of the coupling pin has a beveled portion having a shape which is essentially the same as the cam shape of the lateral surface in the groove of the coupling member, the coupling member and the coupling pin being arranged to be relatively displaceable when the coupling pin is turned in such a manner that the inclined lateral surface in the groove and the beveled, portion of the coupling, pin abut against each other, and to engage each other when the cylindrical surface of the coupling pin, during turning of the sheet-like element, engages the part-circular recess of the coupling member.

By forming the coupling member and the coupling pin with cylindrical surfaces which are turned relative to each other about a common axis, the device will be very stable and robust. Only a small angle of turning is necessary before the coupling pin of the device engages the coupling member.

The inclined cam surface and the corresponding beveled portion make it possible to displace the cylindrical surfaces relative to each other in the direction along the rail when the coupling pin is correctly aligned.

The cutting edge forming between the inclined cam surface and the part-circular recess will have such a shape that the beveled portion of the coupling pin and, thus, the coupling pin are affected towards the center of the recess if one tries to turn the sheet-like element upwards without the coupling pin being perfectly aligned with a recess. As the coupling pin is being turned, with the beveled portion abutting against the cutting edge, a surface with an ever increasing circumference will abut against the cutting edge, which makes it necessary, from considerations of space, to move the coupling pin to a position where the entire circumference can be accommodated, i.e. closer and closer to a position where the center axes of the coupling pin and the recess coincide. This means that the device by itself takes an incorrect position of the sheet-like element at the stage of upwards turning into consideration and compensates for the same. This eliminates the risk that the rail or some other component is broken by turning.

Preferred embodiments are evident from the dependent claims.

BRIEF DESCRIPTION OF THE DRAWINGS

The invention will now be described in more detail with reference to the accompanying schematic drawings which for exemplification illustrates currently preferred embodiments of the invention.

DESCRIPTION OF A PREFERRED EMBODIMENT

Figure 1:
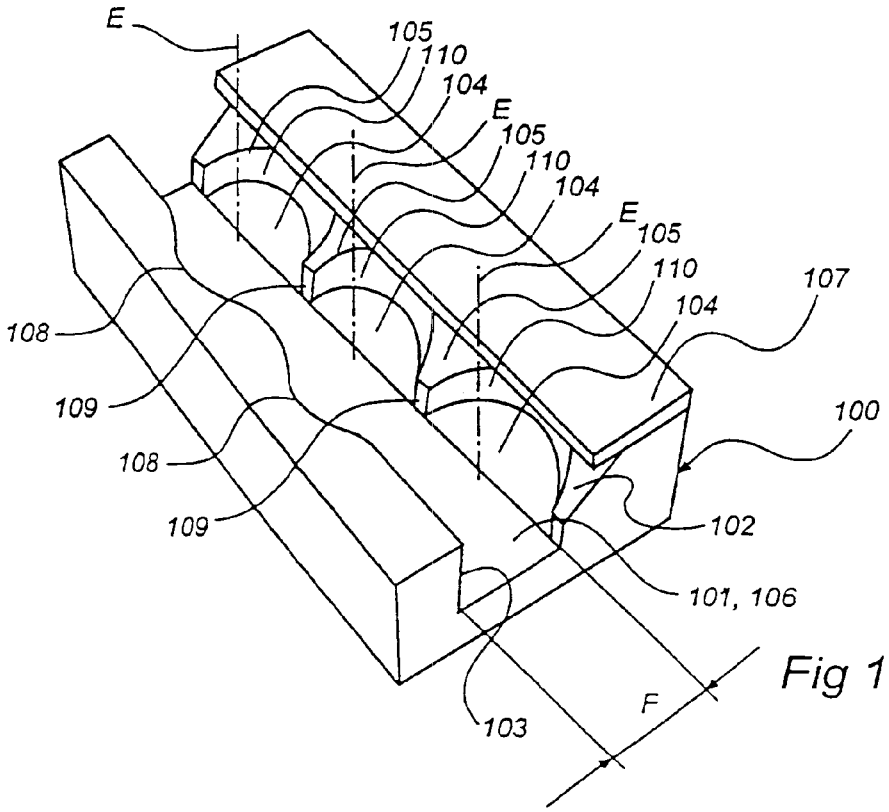
FIG. 1 is a perspective view of the coupling member.
Figure 2:
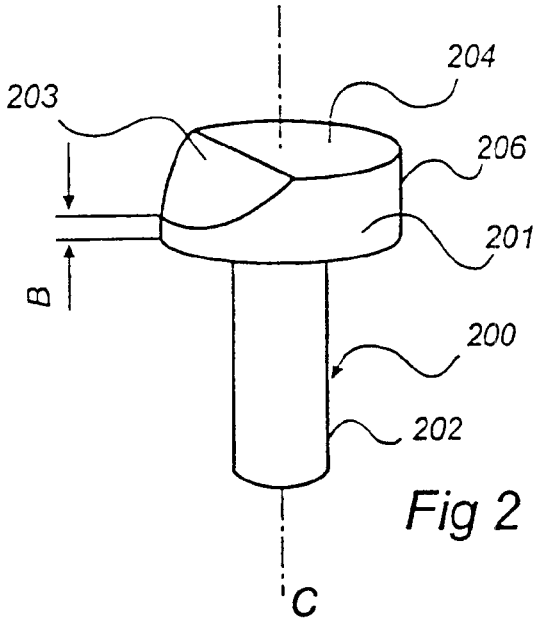
FIG. 2 is a perspective view of the coupling pin seen obliquely from above.
Figure 3:
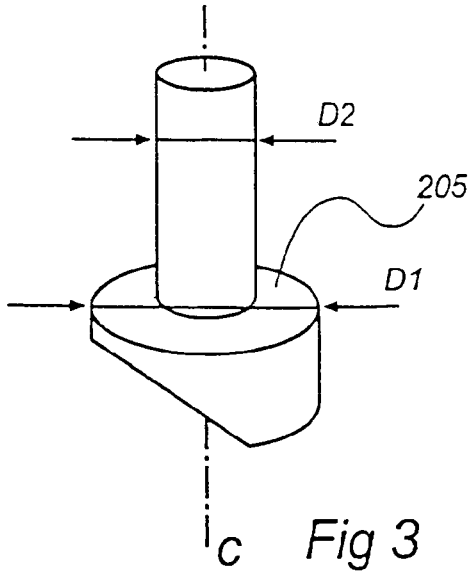
FIG. 3 is a perspective view of the coupling pin seen obliquely from below.
Figure 4:
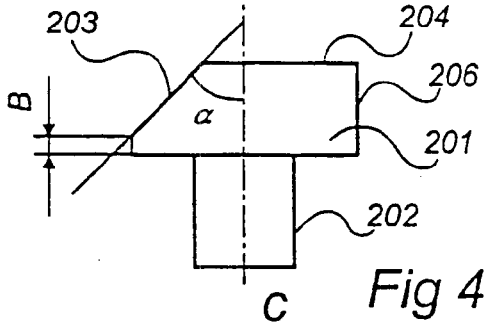
FIG. 4 is a side view of the coupling pin.
Figure 5:
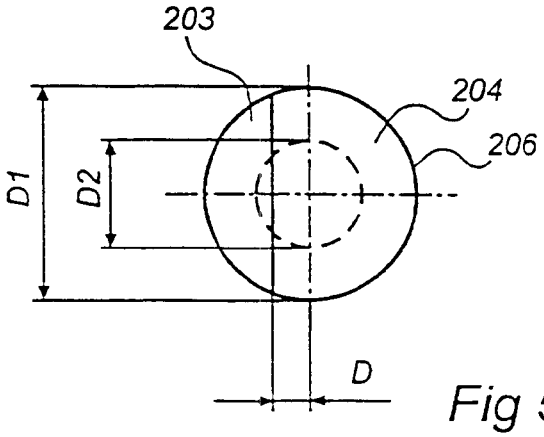
FIG. 5 is a top plan view of the coupling pin.

As is evident from FIG. 1, the coupling member 100 is formed with a groove 101, which extends through the entire coupling member 100 and has an essentially constant width F in its longitudinal direction. The groove 101 has a lateral surface 102 which is inclined, and a lateral surface 103 which is straight. In the inclined lateral surface 102 there are part-circular recesses 104, which are equidistantly spaced from each other at a distance A along the groove 101 (see FIG. 6). The recesses 104 have a center axis E which is perpendicular to the extension of the groove and perpendicular to the base 106 of the groove and a circular extension which is about one third of an entire circumference.

FIGS. 2–5 show that the coupling pin 200 has a cylindrical head 201 and a cylindrical shank 202, the diameter D1 of the head 201 being greater than the diameter D2 of the shank. The head 201 is formed with a plane, inclined beveled portion 203 which has a shape corresponding to the inclined lateral surface 102 in the groove 101 of the coupling member 100. The beveled portion 203 is formed in such a manner that the head 201 has a portion B which extends along the longitudinal axis C of the coupling pin 200 and which has a complete circle diameter D1. Moreover, the beveled portion 203 cuts the upper side 204 of the head 201 on that side of the center axis C on which the coupling pin 203 is positioned at a distance D from the center axis C. The beveled portion 203 is angled at an angle $\alpha$=45° in relation to the center axis C of the coupling pin 200. The beveled portion 203 is positioned at one end of the coupling pin 200 and the shank 202 is positioned at the other end.

Figure 6:
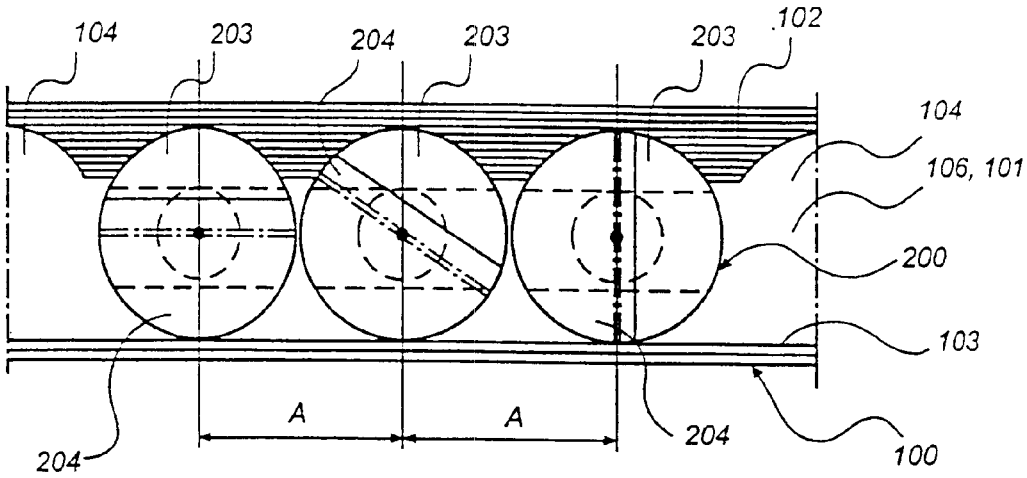
FIG. 6 illustrates how the coupling pin cooperates with the coupling member in three different upward turning positions.

As is evident from FIG. 6, the coupling pin 200 is slidable in the groove 101 of the coupling member 100 when the coupling pin 200 is oriented in such a manner that the beveled portion 203 of the head 201 abuts against the inclined lateral surface 102 of the groove 101. The abutment surfaces of the two inclined surfaces 102, 203 are large owing to this design, which makes the construction very strong and stable.

When the coupling pin 200 has been displaced in the groove 101 in such a manner that the coupling pin 200 is aligned with one of the recesses 104 in the coupling member 100, the coupling pin can be turned about its center axis C. The center axis E of the recesses 104 and the center axis C of the coupling pin 200 are parallel with each other during the entire movement and the cylindrical inner surface 110 of the part-circular recess 104 then cooperates with the cylindrical surface 206 of the head 201 of the coupling pin 200, which results in a very stable engagement.

If the coupling pin 200 is arranged in the vicinity of a recess 104 and one tries to turn the coupling pin 200, the beveled portion 203 will cooperate with the edge 105 which is defined by the inclined surface 102 and the recesses 104 and move the head 201 of the coupling pin 200 into the recess 104. This results in a play of forces which resembles meshing.

The coupling member 100 also has a plate 107, which can be arranged on the coupling member 100 or be integrated therewith. The plate 107 has a lower engaging surface which engages the surface 205 which is defined on the coupling pin 200 by the underside of the head 201 owing to the fact that the head 201 has a diameter D1 greater than the diameter D2 of the shank 202. The engagement of this surface 205 with the plate 107 prevents the head 201 of the coupling pin 200 from being moved away from the groove 101 in a direction which is parallel to its center axis C. In the above-mentioned upwards turning of the coupling pin 200 in the vicinity of a recess 104, the play of forces in fact also causes a power component parallel to the center axis C of the coupling pin 200.

The plate 107 extends in such a manner that its edge engages the shank 202 of the coupling pin 200 and thus guides the coupling pin 200 so that its center axis C is all the time kept parallel with the center axis E of the recesses. The plate 107 can also be supplemented with a corresponding plate (not shown) from the other direction of the groove.

The lateral surface 103 which is straight, i.e. perpendicular to the base 106 of the groove 101, can be completely plane but can also be wave-shaped. The wave formations 108 are arranged along the extension of the groove 101 so as to result in a wider groove 101 opposite to the portions where the recesses 104 cause the narrowest width of the groove 101.

The above-described locking device preventing turning is adapted to be used for slidable and turnable suspension of sheet-like element, such as windowpanes for balconies, glazed verandas or the like.

Figure 9:
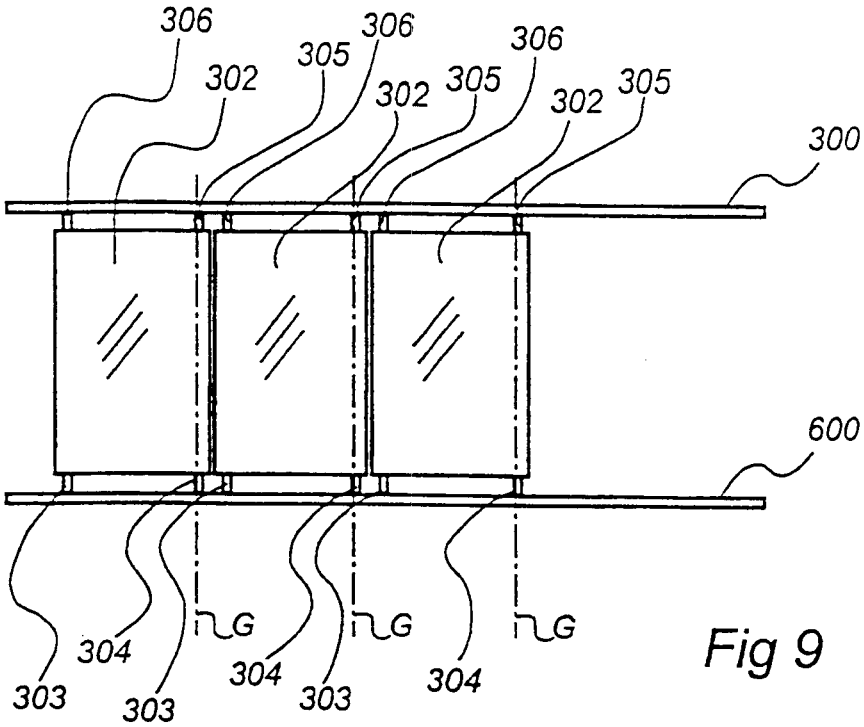
FIG. 9 shows three sheet-like elements suspended between two rails.
Figure 10:
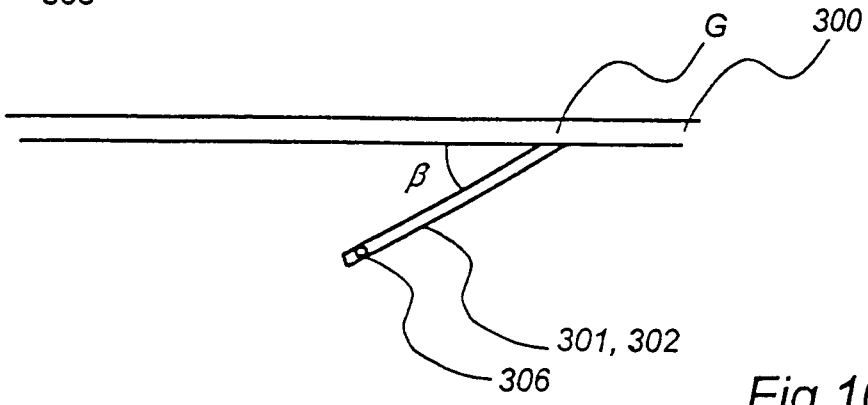
FIG. 10 is a top plan view of how a sheet-like element is opened by being turned about its pivot axis.

As is evident from FIGS. 9 and 10, a number of windowpanes 302 are in their four corners slidably suspended between an upper and a lower rail 300, 600. The locking device is arranged in one of the upper corners, but can also be arranged in two corners on the same side or even in all four corners.

If it should be possible to open the windowpane about only one of the side edges, it is in most cases sufficient to have a locking device in the upper corner on this side. This is due to the fact that in most cases the windowpane 302 is opened by turning when it has been displaced to abut against one end of the rails 300, 600. Owing to the weight of the windowpane 302, the upper part of the windowpane 302 strives towards that part of the windowpane 302 which is turned out of the rails 300, 600, and the lower part of the windowpane 302 strives away from that part of the windowpane 302 which is turned out of the rails 300, 600, i.e. at the lower rail, the abutment against the end of the rail 600 and, thus, also the position are maintained.

In the lower corners 303, 304, the windowpane 302 rests on two ball castors running along a path in the lower rail 600. At the upper rail 300, the windowpane 302 is supported by pins 305, 306 extending upwards through a slot in the upper rail 300. These pins can be, for example, the shank 202 of the coupling pin 200.

The coupling member 100 of the locking device is usually mounted in the upper rail 300 of the two rails between which the windowpane is suspended. The coupling member 100, 400 is arranged inside the upper rail 300 and the coupling pin 200 is non-rotationally arranged on the window frame 301.

A windowpane 302 that is to be opened is displaced along the rails 300, 600 until the coupling pin 200 is aligned with a recess 104 in the coupling member 100. The windowpane 302 can then be opened by being turned about the coupling pin 200 and, thus, about the pivot axis G.

Figure 7:
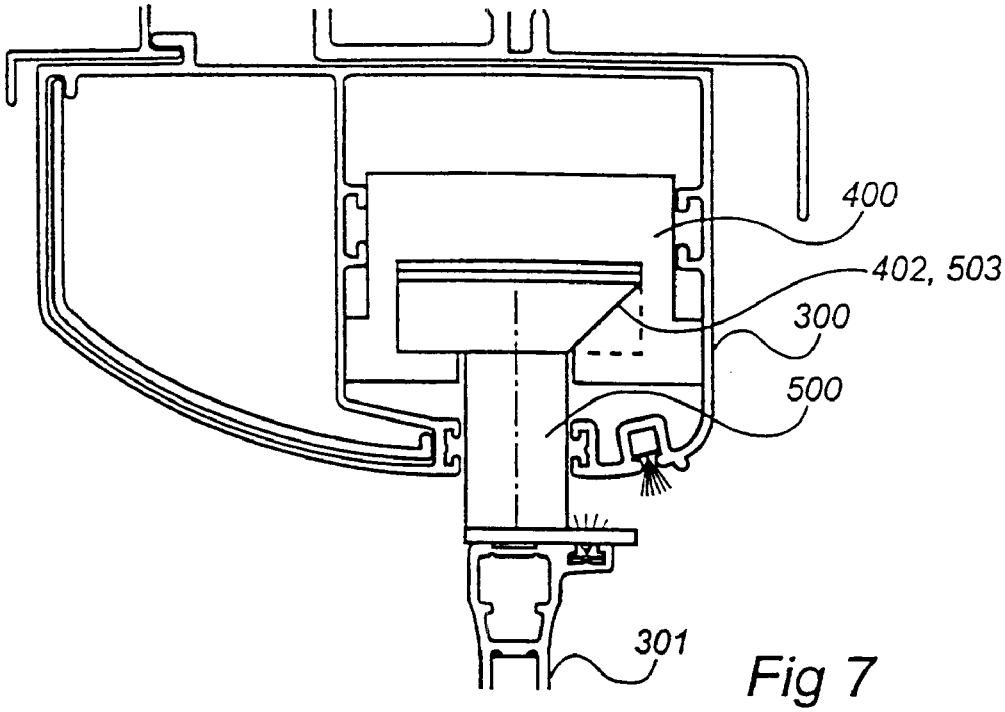
FIG. 7 shows how the coupling member and the coupling pin, according to an alternative embodiment of the invention, are adapted to be mounted in the rail.
Figure 8:
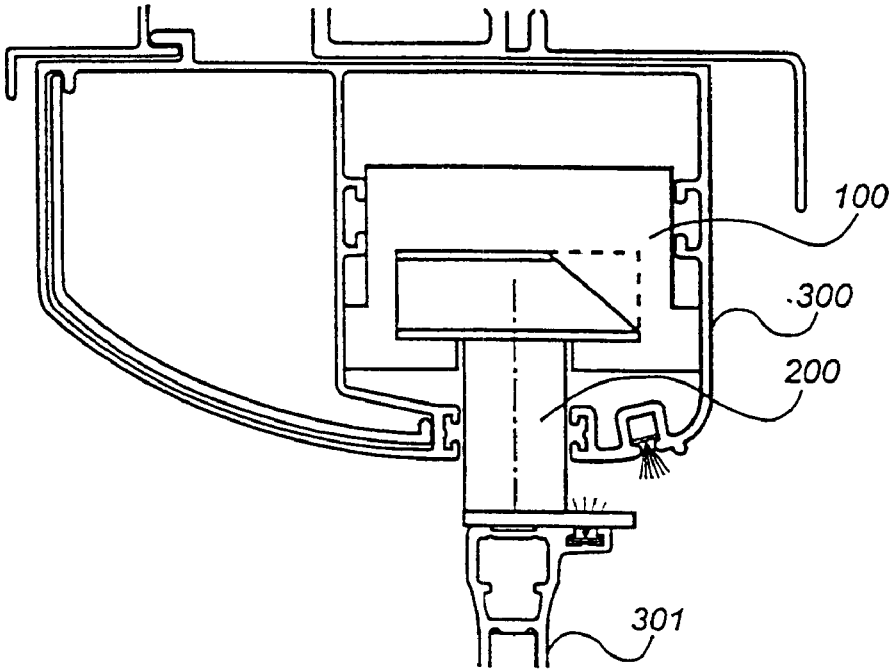
FIG. 8 shows how the coupling member and the coupling pin are adapted to be mounted in the rail.

The coupling member and the coupling pin can be designed in such a manner that the beveled portion 503 is directed towards the window frame 301 and the inclined surface 402 is directed away from the window frame 301 or vice versa, so that the beveled portion 203 is directed away from the window frame 301 and the inclined surface 102 directed towards the window frame 301 (see FIGS. 7 and 8, respectively).

As is evident from FIGS. 7 and 8, the coupling member 100, 400 is arranged at the upper rail 300 in such a manner that the upper rail can be displaced up and down in a direction parallel to the center axis of the coupling pin 200, 500.

Since the recesses 104 are equidistantly spaced from each other at a distance A, it is easy to ensure that the subsequent coupling pins 200 are fit into an adjoining recess 104. For example, the distance A between the recesses 104 can equal the diameter D1 of the head 201 of the coupling pin 200. Consequently, a subsequent windowpane 302 can easily be pushed so that its coupling pin 200 abuts against the coupling pin 200 of the adjoining windowpane 302.

It will be appreciated that a great number of modifications of the embodiments of the invention as described are feasible within the scope of the invention, which is defined in the appended claims.

For instance, the groove of the coupling member or the coupling pin can be formed with a portion beveled for entering. A coupling pin portion beveled for entering is then suitably arranged on that part of the circumference of the head which first comes into contact with the coupling member, i.e. a part of the circumference which makes an angle of 90° to that beveled portion of the head which is adapted to cooperate with the inclined surface of the groove.

Moreover, the shank of the coupling pin can be provided with a telescopic function instead of letting the coupling member be vertically slidable in the rail.

According to a further embodiment (not shown), the inclined lateral surface in the groove is not a plane surface but has a more complex cam shape, which however has a portion which is essentially plane and inclined in a manner similar to that of the inclined plane surface in the preferred embodiment.

Furthermore, the inclined surface 102 and the beveled portion 203 can make a different angle to each other. Under the current conditions, it is convenient if the angle relative to the pivot axis of the sheet-like element is in the range 10–70°, preferably 25–65° and most preferably 35–55°.

What is claimed is:

1. A device for turnable and slidable suspension of a sheet element, said element being slidably supported by at least one rail and turnable about a pivot axis which is fixed relative to the sheet element, comprising a coupling member supported by said at least one rail and having an elongate groove extending in essentially a same direction as the at least one rail, and a coupling pin non-rotationally arranged on the sheet element so as to coincide with the pivot axis of said element and which is slidable in the groove of the coupling member, the coupling pin and the coupling member being constructed and arranged to engage each other when the sheet element is turned relative to the at least one rail, wherein the groove of the coupling member has an inclined, lateral cam surface, the coupling member has at least one essentially part-circular recess in the inclined lateral cam surface, the recess having a center axis which is essentially parallel to the pivot axis of the sheet element, the coupling pin has a cylindrical surface with a center axis which is essentially parallel to the pivot axis of the sheet element, the cylindrical surface of the coupling pin has a beveled portion having a shape which is essentially the same as a cam shape of the lateral cam surface in the groove of the coupling member, and the coupling member and the coupling pin being arranged to be displaceable when the coupling pin is turned in such a manner that the inclined lateral surface in the groove and the beveled portion of the coupling pin abut against each other, and to engage each other when the cylindrical surface of the coupling pin, during turning of the sheet element, engages the part-circular recess of the coupling member.

2. A device as claimed in claim 1, wherein the groove has a width which varies in a direction along the pivot axis of the sheet element and is essentially constant in a direction along the groove.

3. A device as claimed in claim 1 or 2, wherein the beveled portion of the coupling pin is located at a first end of the cylindrical surface and the coupling pin is non-rotationally arranged on the sheet element at a second end of the cylindrical surface.

4. A device as claimed in claim 1, wherein the coupling pin and the coupling member each have abutment surfaces which in cooperation with each other keep the coupling pin in the coupling member and counteract the forces arising from contact between the lateral cam surface in the groove and the beveled portion of the coupling pin.

5. A device as claimed in claim 1, wherein the coupling member has a projecting portion having an abutment surface directed towards the coupling pin and the coupling pin has a portion with a diameter (D2) which is smaller than a diameter (D1) of the cylindrical surface to form a surface which engages the abutment surface of the coupling member.

6. A device as claimed in claim 5, wherein the coupling member has at least two recesses in the lateral cam surface of the groove, the center axis of the at least one essentially part-circular recess being positioned at a distance from each other which equals the cylindrical surface on the diameter (D1) of the coupling pin.

7. A device as claimed in claim 1, wherein the inclined lateral cam surface is an essentially plane, inclined surface.

8. A device as claimed in claim 1, wherein the beveled portion of the coupling pin is an essentially plane, inclined surface.

9. A device as claimed in claim 1, wherein the lateral surface is essentially angled at an angle ($\alpha$) relative to the pivot axis of the sheet element in a range of 10–70°.

10. A device as claimed in claim 1, wherein the beveled portion is essentially angled at an angle ($\alpha$) relative to the pivot axis of the sheet element in a range of 10–70°.

11. A device as claimed in claim 1, wherein the beveled portion of the coupling pin is such that the coupling pin has a circumferentially cylindrical surface on a portion extending along the pivot axis of the sheet element.

12. A device as claimed in claim 1, wherein the beveled portion of the coupling pin is such that the cylindrical surface, at a greatest extent of the beveled portion, in a circumferential direction exceeds half of the circumference.

13. A device as claimed in claim 1, wherein a part-circular-shape of the at least one essentially part-circular recess in the lateral surface of the groove constitutes at least one fifth of the circumference of a corresponding entire circle.

14. A device as claimed in claim 1, wherein the coupling pin has a portion which is adapted to take up changes in distance between the cylindrical surface of the coupling pin and the sheet element in a direction essentially parallel to the pivot axis of the sheet element.

15. A device as claimed in claim 1, wherein the groove of the coupling member has, at least at one end, a portion beveled for entering, to facilitate initial engagement between the coupling pin and the coupling member.

16. A device as claimed in claim 1, wherein the coupling pin has, at least on one side, the beveled portion to facilitate initial engagement between the coupling pin and the coupling member.

17. A device as claimed in claim 16, wherein the beveled portion is formed on the coupling pin, displaced through about 90° in a circumferential direction in relation to the beveled portion of the coupling pin which has a shape which is essentially the same as the cam shape of the lateral cam surface in the groove of the coupling member.

* * * * *